US010066638B2

(12) United States Patent
Bessho

(10) Patent No.: US 10,066,638 B2
(45) Date of Patent: Sep. 4, 2018

(54) CENTRIFUGAL COMPRESSOR AND TURBOCHARGER

(71) Applicant: IHI Corporation, Koto-ku (JP)

(72) Inventor: Yasutaka Bessho, Tokyo (JP)

(73) Assignee: IHI Corporation, Koto-ku (JP)

( * ) Notice: Subject to any disclaimer, the term of this patent is extended or adjusted under 35 U.S.C. 154(b) by 307 days.

(21) Appl. No.: 14/950,094

(22) Filed: Nov. 24, 2015

(65) Prior Publication Data

US 2016/0076553 A1 Mar. 17, 2016

Related U.S. Application Data

(63) Continuation of application No. PCT/JP2014/069936, filed on Jul. 29, 2014.

(30) Foreign Application Priority Data

Aug. 6, 2013 (JP) ..... 2013-162984

(51) Int. Cl.

| | |
|---|---|
| ***F04D 29/44*** | (2006.01) |
| ***F04D 25/02*** | (2006.01) |
| ***F04D 29/68*** | (2006.01) |
| ***F02B 33/40*** | (2006.01) |
| ***F04D 17/10*** | (2006.01) |

(Continued)

(52) U.S. Cl.

CPC ..... *F04D 29/441* (2013.01); *F02B 33/40* (2013.01); *F04D 17/10* (2013.01); *F04D 25/024* (2013.01); *F04D 29/284* (2013.01); *F04D 29/4206* (2013.01); *F04D 29/681* (2013.01); *F02B 37/00* (2013.01); *F05D 2220/40* (2013.01); *F05D 2250/52* (2013.01)

(58) Field of Classification Search

CPC ..... F01D 29/441; F01D 29/444; F01D 29/448

See application file for complete search history.

(56) References Cited

U.S. PATENT DOCUMENTS 4,181,466 A * 1/1980 Owen ..... F04D 25/04 29/888.024
4,251,183 A * 2/1981 Liu ..... F04D 17/122 138/39

(Continued)

FOREIGN PATENT DOCUMENTS

CN 1116280 A 2/1996
CN 101057079 A 10/2007

(Continued)

OTHER PUBLICATIONS

Combined Chinese Office Action and Search Report dated Nov. 2, 2016 in Patent Application No. 201480032889.X (with English translation of Categories of Cited Documents).

(Continued)

*Primary Examiner* — Ninh H Nguyen

(74) *Attorney, Agent, or Firm* — Oblon, McClelland, Maier & Neustadt, L.L.P.

(57) ABSTRACT

An annular diffuser is formed on an outlet side of a wheel in a housing. A shroud-side wall surface and a hub-side wall surface of the diffuser are parallel to a radial direction, respectively. A plurality of annular steps is formed on the shroud-side wall surface of the diffuser. Each step is formed so as to expand a flow passage width of the diffuser along a flow direction of a main flow.

10 Claims, 7 Drawing Sheets

(51) Int. Cl.

| | |
|---|---|
| ***F04D 29/28*** | (2006.01) |
| ***F04D 29/42*** | (2006.01) |
| *F02B 37/00* | (2006.01) |

(56) References Cited

U.S. PATENT DOCUMENTS

| | | | | |
|---|---|---|---|---|
| 4,378,194 | A | 3/1983 | Bandukwalla | |
| 5,529,457 | A * | 6/1996 | Terasaki | F04D 29/444 415/208.3 |
| 8,157,516 | B2 | 4/2012 | Chen et al. | |
| 8,915,711 | B2 * | 12/2014 | Billotey | F04D 29/289 416/183 |
| 2009/0060731 | A1 | 3/2009 | Chen et al. | |

FOREIGN PATENT DOCUMENTS

| | | | |
|---|---|---|---|
| CN | 102171459 | A | 8/2011 |
| JP | 58-183899 | | 10/1983 |
| JP | 60-70798 | U | 5/1985 |
| JP | 61-84199 | U | 6/1986 |
| JP | 62-188598 | U | 12/1987 |
| JP | 2-12097 | U | 1/1990 |
| JP | 7-8597 | U | 2/1995 |
| JP | 10-176699 | | 6/1998 |
| JP | 2005-240681 | | 9/2005 |
| JP | 2006-220053 | | 8/2006 |
| JP | 2008-510100 | | 4/2008 |
| JP | 2008-163821 | | 7/2008 |
| JP | 2009-2305 | | 1/2009 |
| JP | 2010-196542 | | 9/2010 |
| JP | 2011-64111 | | 3/2011 |
| JP | 2012-41844 | | 3/2012 |
| JP | 2013-204550 | | 10/2013 |
| JP | 2014-74389 | | 4/2014 |
| JP | 2014-74390 | | 4/2014 |

OTHER PUBLICATIONS

Extended European Search Report dated Feb. 23, 2017 in Patent Application No. 14834428.6.

International Search Report dated Nov. 4, 2014 in PCT/JP2014/069936, filed on Jul. 29, 2014 ( with English translation).

Written Opinion dated Nov. 4, 2014 in PCT/JP2014/069936, filed on Jul. 29, 2014.

* cited by examiner 9
27
27h
35
α
β
δ
7
27s
29
7s
23
L
R

CENTRIFUGAL COMPRESSOR AND TURBOCHARGER

CROSS REFERENCE TO RELATED APPLICATIONS

This application is a continuation application of International Application No. PCT/JP2014/069936, filed on Jul. 29, 2014, which claims priority to Japanese Patent Application No. 2013-162984, filed on Aug. 6, 2013, the entire contents of which are incorporated by reference herein.

BACKGROUND

1. Technical Field

The present disclosure relates to a centrifugal compressor that compresses a fluid (gas, such as air, is included) utilizing a centrifugal force and, in particular, to a diffuser in the centrifugal compressor.

2. Description of the Related Art

In recent years, various research and development of a centrifugal compressor used for a turbocharger, a gas turbine, an industrial air facility, etc. have been conducted (refer to Japanese Patent Laid-Open Publication Nos. 2009-2305, 2006-220053, and 2010-196542).

A general centrifugal compressor includes a housing. The housing has a shroud thereinside. In the housing, a wheel (an impeller) is rotatably provided around an axial center thereof. The wheel includes a disk. A hub surface of the disk extends from one side in an axial direction toward an outside in a radial direction of the turbine wheel. On the hub surface of the disk, a plurality of blades is integrally provided spaced apart from each other in a peripheral direction. A tip edge of each blade extends along the shroud of the housing.

An annular diffuser (a diffuser flow passage) that decreases a velocity of a compressed fluid (a compression fluid) to thereby raise a pressure thereof is formed on an outlet side of the wheel in the housing. In addition, a scroll (a scroll flow passage) that communicates with the diffuser is formed on an outlet side of the diffuser in the housing.

SUMMARY

By the way, flow separation (a separation vortex) associated with rapid change of a flow passage shape is generated on an outlet side of a shroud-side wall surface of the diffuser during operation of the centrifugal compressor. Meanwhile, when the flow separation develops, an effective flow passage area in the outlet side of the diffuser decreases. As a result, a velocity of a flow of a main flow cannot be sufficiently decreased by the diffuser, and static pressure recovery performance of the diffuser deteriorates. In addition, turbulence occurs in a flow in a discharge port (a discharge flow passage) located on a downstream side of the scroll by collision (interference) of a low pressure part (a blockage, a low pressure region, or a block region) and the flow of the main flow in the scroll due to the flow separation in the outlet side of the shroud-side wall surface of the diffuser, and compressor efficiency of the centrifugal compressor deteriorates.

Consequently, an object of the present disclosure is to provide a centrifugal compressor and a turbocharger that can solve the above-mentioned problems.

A first aspect of the present disclosure is a centrifugal compressor that compresses a fluid (gas, such as air, is included) utilizing a centrifugal force, the centrifugal compressor including: a housing having a shroud thereinside; a wheel rotatably provided in the housing; a diffuser (a diffuser flow passage) formed outside in a radial direction of an outlet side of the wheel in the housing; and a scroll (a scroll flow passage) formed on an outlet side of the diffuser in the housing, in which a shroud-side wall surface and a hub-side wall surface of the diffuser extend in the radial direction, respectively, and in which at least one step is formed on the shroud-side wall surface of the diffuser so as to expand a flow passage width of the diffuser along a flow direction of a main flow.

Note that in the specification and claims of the present application, "being provided" means including being indirectly provided through another member in addition to being directly provided, and that "being integrally provided" means including being integrally formed. In addition, an "axial direction" means an axial direction of a wheel, and a "radial direction" means a radial direction of the wheel. Further, a "shroud-side wall surface" means a wall surface located on a side of a surface in which a shroud of a housing has extended outside in the radial direction, and a "hub-side wall surface" means a wall surface located on a side of a surface in which a hub surface of a disk has extended outside in the radial direction.

A second aspect of the present disclosure is a turbocharger, the turbocharger including the centrifugal compressor according to the first aspect.

According to the present disclosure, development of separation of the outlet side of the shroud-side wall surface of the diffuser can be suppressed during operation of the centrifugal compressor. Therefore, decrease of an effective flow passage area of the outlet side of the diffuser is suppressed, and a velocity of the flow of the main flow can be sufficiently decreased by the diffuser. In addition, a low pressure part due to flow separation can be reduced in the outlet side of the shroud-side wall surface of the diffuser during operation of the centrifugal compressor. Therefore, collision (interference) of the low pressure part and the flow of the main flow in the scroll can be lessened to thereby suppress occurrence of turbulence in the flow of the main flow in a downstream side of the scroll. Consequently, according to the present disclosure, improvement in compressor efficiency of the centrifugal compressor can be achieved, while enhancing static pressure recovery performance of the diffuser.

BRIEF DESCRIPTION OF THE DRAWINGS

FIG. 5A shows a case of the inventive example, FIG. 5B shows a case of the comparative example.

FIG. 6A shows the case of the inventive example, FIG. 6B shows the case of the comparative example.

DESCRIPTION OF THE EMBODIMENTS

The present disclosure is based on a new knowledge mentioned below.

Figure 4B:
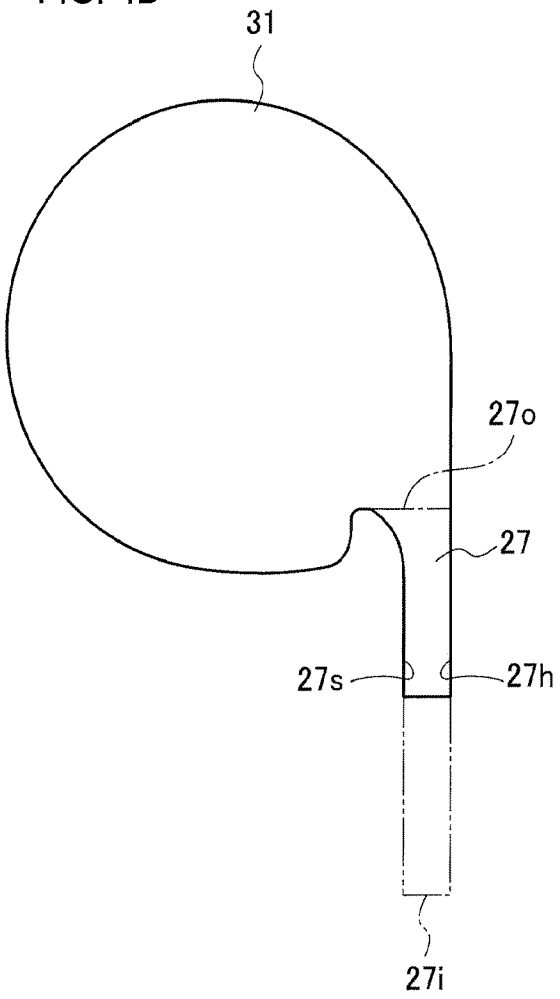
FIG. 4B is a schematic view showing a configuration around a diffuser according to a comparative example.
Figure 4A:
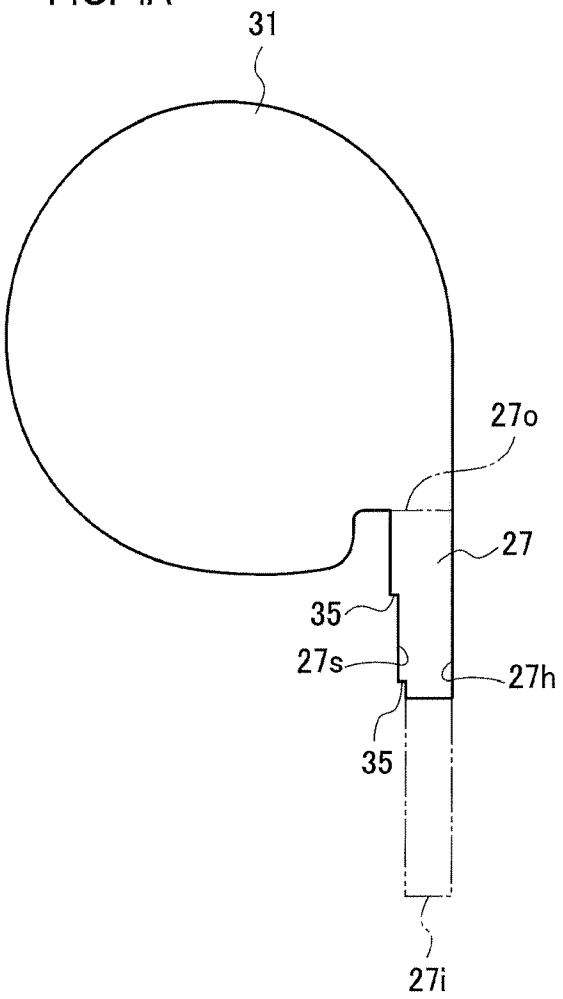
FIG. 4A is a schematic view showing a configuration around a diffuser according to an inventive example.
Figure 5B:
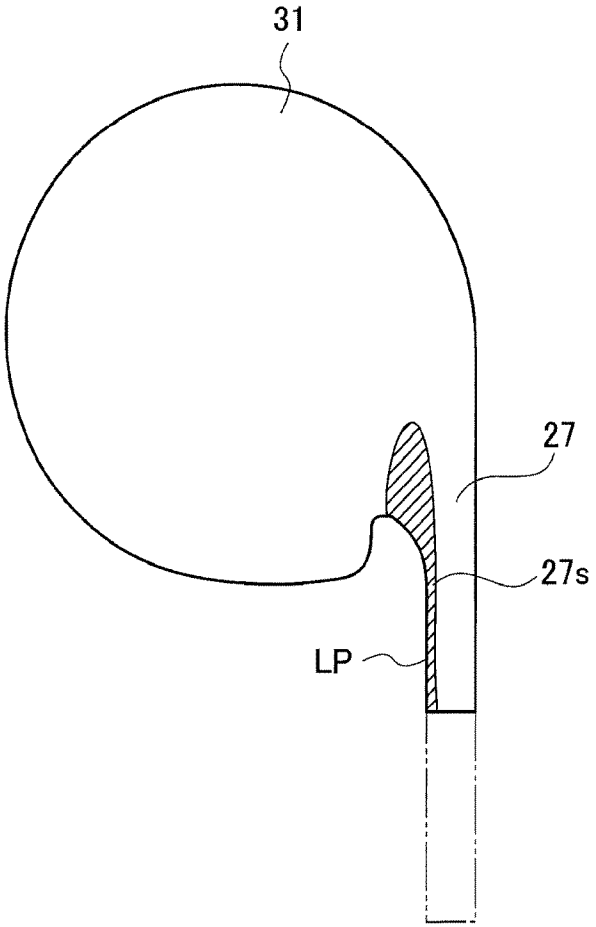
FIGS. 5A and 5B are views each showing a region where a low pressure part is generated in an actuating region of a large flow rate side (a choke side).
Figure 5A:
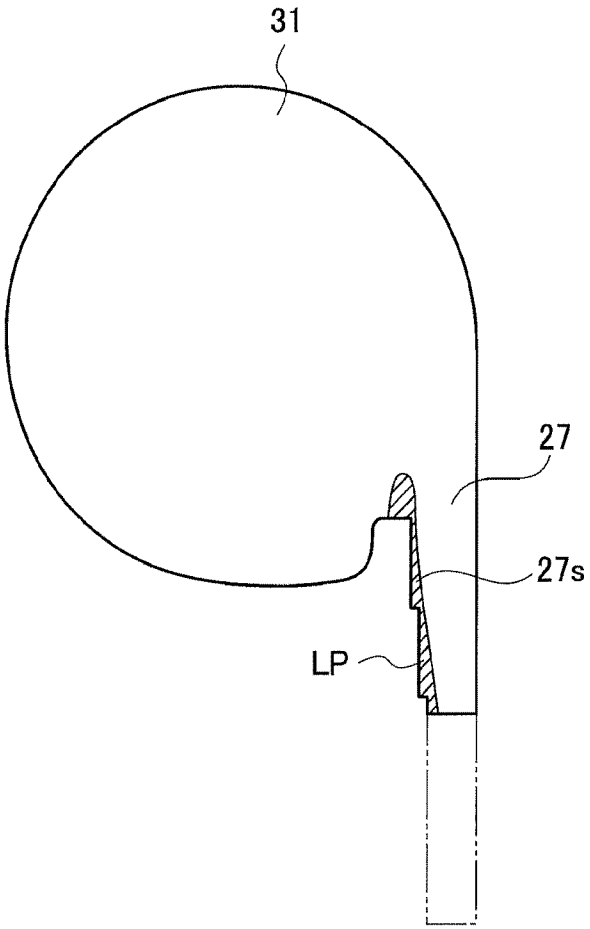

Namely, the new knowledge is that development of flow separation (a separation vortex) is suppressed in an outlet 27*o* side of a shroud-side wall surface 27*s* of a diffuser 27 during operation of a centrifugal compressor, in a case where an annular step 35 is formed on the shroud-side wall surface 27*s* of the diffuser 27 under predetermined conditions (refer to FIG. 4A), compared with a case where the annular step 35 is not formed (refer to FIG. 4B), and that thereby, a low pressure part LP by the separation is reduced (refer to FIGS. 5A and 5B). The reason is considered as follows. The separation vortex was locally generated near the annular step 35 to generate the low pressure part LP near the shroud-side wall surface 27*s* of the diffuser 27, and thereby a flow of a main flow became easy to move along the shroud-side wall surface 27*s* of the diffuser 27 in a front side of an outlet 27*o* of the diffuser 27. In addition, the predetermined conditions are the following: the shroud-side wall surface 27*s* and a hub-side wall surface 27*h* of the diffuser 27 are parallel to a radial direction of a wheel, respectively; and the annular step 35 is formed so as to expand a flow passage width of the diffuser 27 along a flow direction of the main flow. Note that a symbol 27*i* in FIGS. 4A and 4B denotes an inlet of the diffuser 27 that communicates with a housing chamber (refer to FIG. 1) of a wheel (an impeller) 13.

Here, FIG. 4A is a schematic view showing a configuration around the diffuser 27 according to an inventive example. FIG. 4B is a schematic view showing a configuration around the diffuser 27 according to a comparative example. FIGS. 5A and 5B are views each showing a region where a low pressure part is generated in an actuating region of a large flow rate side (a choke side). FIG. 5A shows the case of the inventive example, FIG. 5B shows the case of the comparative example. In addition, the region where the low pressure part LP was generated was determined by CFD (Computational Fluid Dynamics) analysis. Further, although illustration is omitted, similar analysis results could be obtained not only in the actuating region of the large flow rate side but also in actuating regions of a small flow rate side (a surge side) and near a peak of compressor efficiency.

An embodiment of the present disclosure will be explained with reference to FIGS. 1 to 3. Note that "L" is a left direction, and "R" is a right direction as shown in the drawings.

Figure 1:
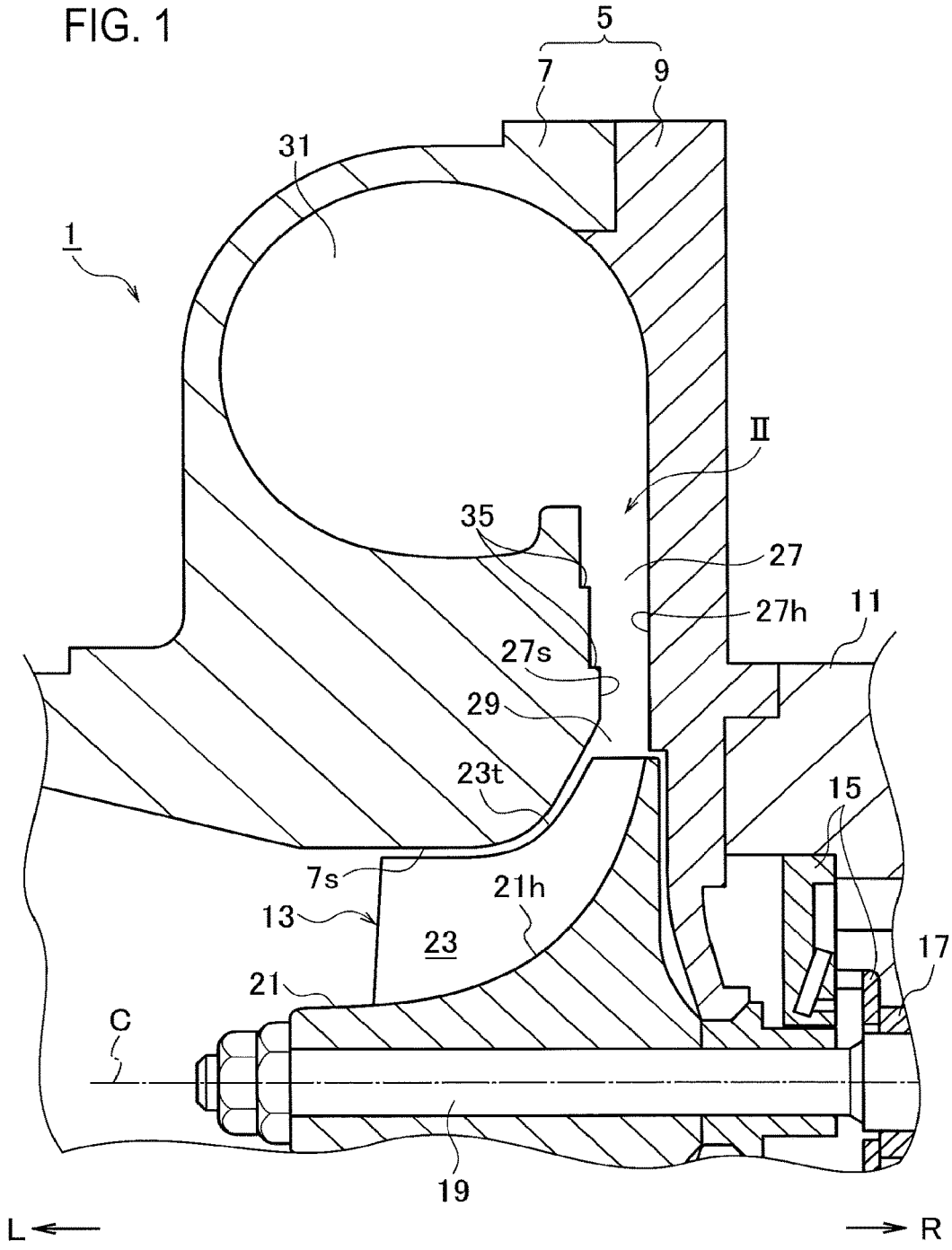
FIG. 1 is an enlarged view of an arrow part I in FIG. 3.
Figure 3:
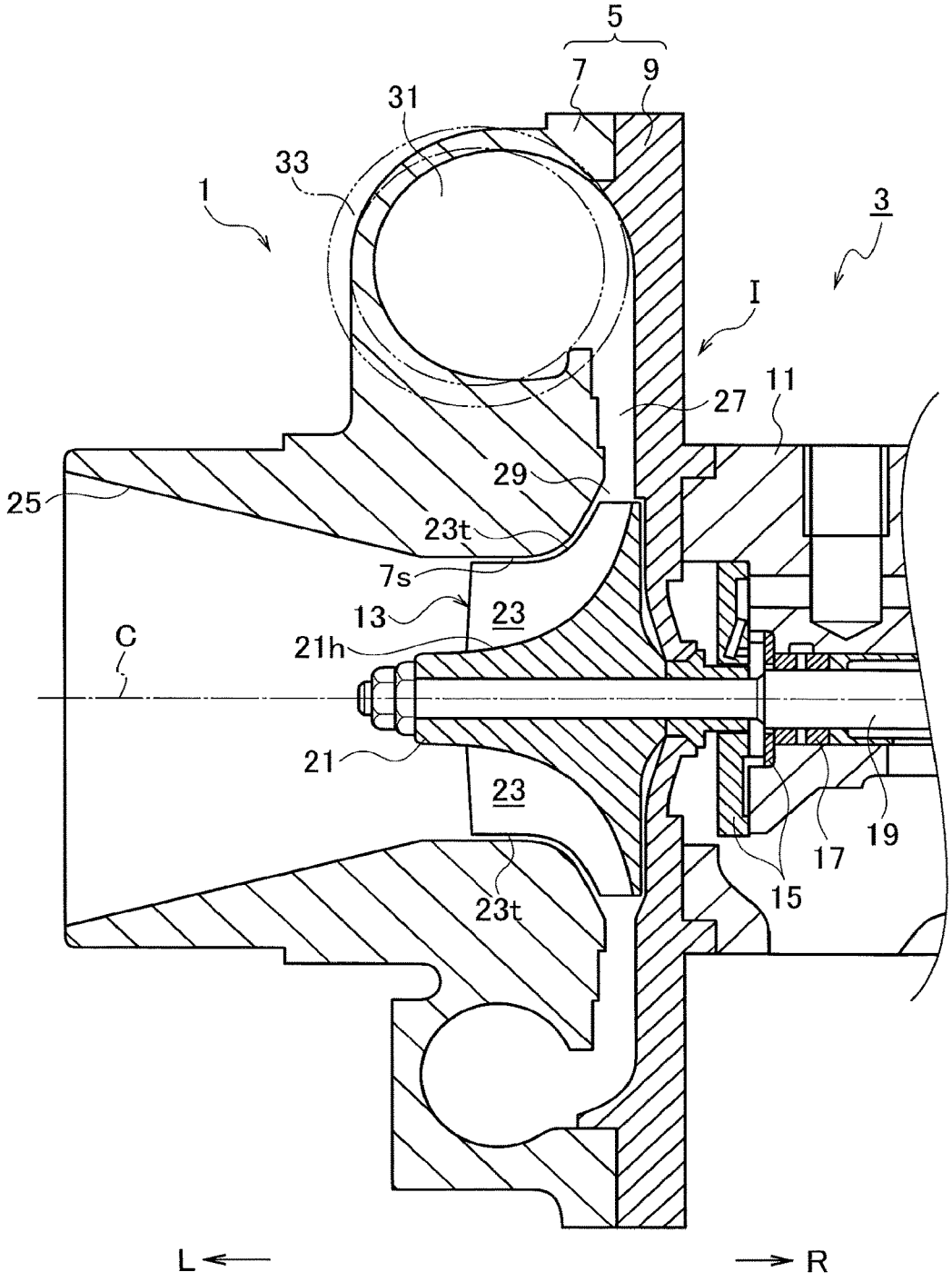
FIG. 3 is a front cross-sectional view showing a centrifugal compressor etc. according to an embodiment of the present disclosure.

As shown in FIGS. 1 and 3, a centrifugal compressor 1 according to the embodiment of the present disclosure is used for a turbocharger 3, and compresses air utilizing a centrifugal force.

The centrifugal compressor 1 includes a housing (a compressor housing) 5. The housing 5 includes a housing body 7 having a shroud 7*s* thereinside, and a seal plate 9 provided on a right side of the housing body 7. Note that the seal plate 9 is coupled integrally with another housing (a bearing housing) 11 in the turbocharger 3.

In the housing 5, the wheel (the compressor wheel) 13 is rotatably provided around an axial center C thereof. The wheel 13 is coupled integrally with a left end of a rotation shaft 19. The rotation shaft 19 is rotatably provided in the housing 11 through a plurality of thrust bearings 15 and a plurality of (only one is shown) radial bearings 17. In addition, the wheel 13 includes a disk 21. The disk 21 has a hub surface 21*h*. The hub surface 21*h* extends outside in a radial direction (a radial direction of the wheel 13) from a left direction (one side in an axial direction of the wheel 13). Further, on the hub surface 21*h* of the disk 21, a plurality of blades 23 with a same axial length is integrally formed spaced apart from each other in a peripheral direction. A tip edge 23*t* of each blade 23 extends along the shroud 7*s* of the housing body 7. Note that plural types of blades (illustration is omitted) with different axial lengths may be used instead of using the plurality of blades 23 with the same axial length.

An introducing port (an introducing flow passage) 25 is formed on an inlet side of the wheel 13 in the housing body 7. The introducing port 25 introduces air into the housing 5. In addition, the introducing port 25 is connected to an air cleaner (illustration is omitted) that purifies the air. The diffuser (the diffuser flow passage) 27 is formed on an outlet side of the wheel 13 in the housing 5. The diffuser 27 decreases a velocity of compressed air (compression air) to thereby raise a pressure thereof. The diffuser 27 is, for example, formed annularly. A throttle part (a throttle flow passage) 29 is formed between the wheel 13 and the diffuser 27 in the housing 5. A flow passage width of the throttle part 29 becomes gradually smaller along the flow direction of the main flow. The throttle part 29 is, for example, formed annularly. The throttle part 29 communicates with the diffuser 27.

A scroll (a scroll flow passage) 31 is formed on an outlet side of the diffuser 27 in the housing 5. The scroll 31 is formed spirally. The scroll 31 communicates with the diffuser 27. A cross-sectional area of a winding end side (a downstream side) of the scroll 31 is larger than that of a winding start side (an upstream side) thereof. A discharge port (a discharge flow passage) 33 is formed in an appropriate position of the housing body 7. The discharge port 33 discharges compressed air outside the housing 5. The discharge port 33 communicates with the scroll 31, and is connected to an intake pipe (illustration is omitted) of an engine side, such as an intake manifold or an intercooler of an engine.

Figures 2A, 2B, 2C:
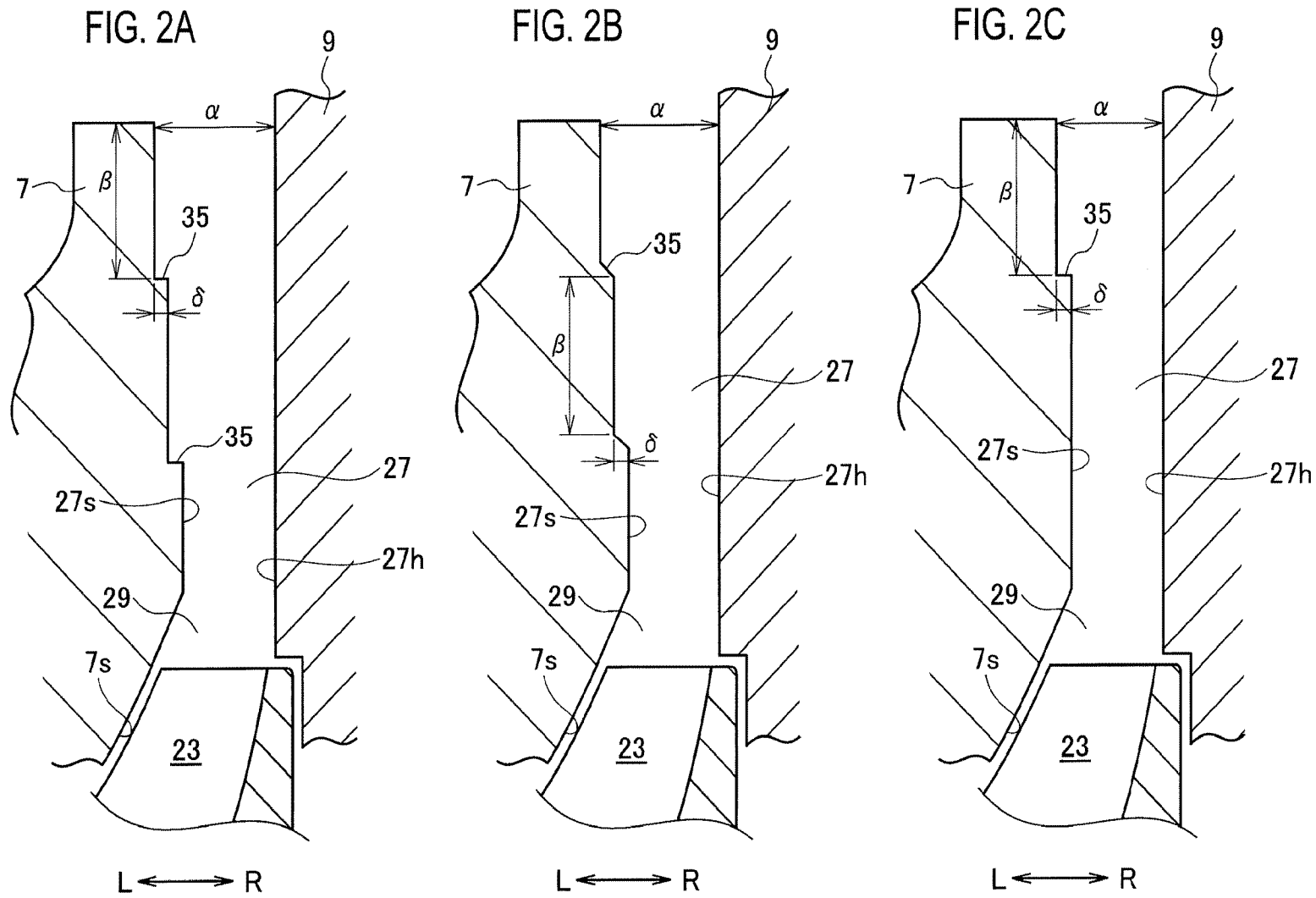
FIG. 2A is an enlarged view of an arrow part II in FIG. 1, and FIGS. 2B and 2C are views showing different aspects of a step.

As shown in FIGS. 1 and 2A, the shroud-side wall surface 27*s* and the hub-side wall surface 27*h* of the diffuser 27 are provided extending in the radial direction (radial direction of the wheel 13). For example, they can be parallel to the radial direction, respectively. Note that the shroud-side wall surface 27*s* means a wall surface located on a side of a surface in which the shroud 7*s* of the housing body 7 has extended outside in the radial direction. The hub-side wall surface 27*h* means a wall surface located on a side of a surface in which the hub surface 21*h* of the disk 21 has extended outside in the radial direction. Here, the above-mentioned parallelism need not be strict. Namely, the shroud-side wall surface 27*s* and the hub-side wall surface 27*h* may incline in the radial direction at angles of approximately several degrees.

The plurality of annular steps 35 is formed in an intermediate part of the shroud-side wall surface 27*s* of the diffuser 27 (between the inlet 27*i* and the outlet 27*o* of the diffuser 27). Each step 35 is formed so as to expand the flow passage width of the diffuser 27 along the flow direction of the main flow. Each step 35 locally generates a separation vortex. Each step 35 is parallel to a flow passage width direction (a horizontal direction) of the diffuser 27. However, each step 35 may linearly or curvedly incline to the flow passage width direction of the diffuser 27 as shown in FIG. 2B. Further, the number of the steps 35 may be a single (one) as shown in FIG. 2C. Here, the above-mentioned parallelism need not be strict.

The steps 35 need not be a continuous annular shape. For example, the step 35 may be provided only in a particular region in the peripheral direction, such as a vicinity of a tongue of the scroll winding end side. However, machining becomes easy when the step 35 is formed annularly.

The number of the steps 35 may be arbitrarily selected according to engine specifications. However, for example, an effect can be exerted at a pinpoint in a particular actuating region by providing the single step 35, and an effect can be exerted in a wider actuating region compared with a case of providing the single step 35, by providing the plurality of steps 35. Here, two steps 35 can be provided as one example of providing the plurality of steps 35. Time and effort required for machining work of the steps are suppressed as much as possible by providing the two steps 35, and an effect can be exerted in a wider range compared with the case of providing the single step 35.

A step amount $\delta$ of the step 35 is set to be 5 to 30% of a flow passage width $\alpha$ of the outlet 27*o* of the diffuser 27, and is preferably set to be 10 to 20% (0.05 to 0.30 times, and preferably, 0.10 to 0.20 times). It is because if the step amount $\delta$ is less than 5%, it might become difficult to locally generate a separation vortex with sufficient strength (vorticity) near the step 35 that the step amount $\delta$ is made to be set to be not less than 5% of the flow passage width $\alpha$. Meanwhile, it is because if the step amount $\delta$ exceeds 30%, the separation vortex (separation) generated by the step 35 might increase that the step amount $\delta$ is set to be less than 30% of the flow passage width $\alpha$.

The shroud-side wall surface 27*s* of the diffuser 27 has a portion continuous with (adjacent to) an outside in a radial direction of the step 35. A length $\beta$ in the radial direction of the portion is set to be 5 to 30 times of the step amount $\delta$ of the step 35, and is preferably set to be 10 to 20 times thereof. It is because if the length $\beta$ is less than 5 times, it might become difficult to make the flow of the main flow move along the shroud-side wall surface 27*s* of the diffuser 27 in the front side of the outlet 27*o* of the diffuser 27 that the length $\beta$ is made to be set to be not less than 5 times of the step amount $\delta$. Meanwhile, it is because if the length $\beta$ exceeds 30 times, a separation vortex (separation) of a new flow might be generated on the front side of the outlet 27*o* of the diffuser 27 in the shroud-side wall surface 27*s* of the diffuser 27, and an effective flow passage area in the diffuser 27 might decrease that the length $\beta$ is set to be not more than 30 times of the step 35.

Subsequently, actions and effects of the embodiment of the present disclosure will be explained.

The wheel 13 is rotated integrally with the rotation shaft 19 around the axial center of the wheel 13 by drive of a radial turbine (illustration is omitted) in the turbocharger 3, and thereby air introduced into the housing 5 from the introducing port 25 can be compressed. A pressure of the compressed air (compression air) is then raised, while a velocity thereof is decreased by the diffuser 27, and the air whose pressure has been raised is discharged outside the housing 5 from the discharge port 33 via the scroll 31.

The shroud-side wall surface 27*s* and the hub-side wall surface 27*h* of the diffuser 27 are parallel to the radial direction, respectively. In addition, the annular step 35 is formed in the intermediate part of the shroud-side wall surface 27*s* of the diffuser 27 so as to expand the flow passage width of the diffuser 27 along the flow direction of the main flow. Therefore, when the above-mentioned new knowledge is applied, development of the flow separation (separation vortex) in the outlet 27*o* side of the diffuser 27 in the shroud-side wall surface 27*s* is suppressed during operation of the centrifugal compressor 1 (operation of the turbocharger 3), and a low pressure part (a blockage, a low pressure region, or a block region) due to the separation can be reduced.

Accordingly, according to the embodiment of the present disclosure, development of the flow separation of the outlet 27*o* side of the diffuser 27 in the shroud-side wall surface 27*s* can be suppressed during the operation of the centrifugal compressor 1. Therefore, decrease of an effective flow passage area of the outlet 27*o* side of the diffuser 27 can be suppressed. Accordingly, a velocity of the flow of the main flow can be sufficiently decreased by the diffuser 27. In addition, the low pressure part LP due to the flow separation of the outlet 27*o* side of the diffuser 27 in the shroud-side wall surface 27*s* can be reduced during the operation of the centrifugal compressor 1. Therefore, collision (interference) of the low pressure part LP and the flow of the main flow in the scroll 31 can be lessened to thereby suppress occurrence of turbulence in the flow of the main flow in the discharge port 33 located on a downstream side of the scroll 31. Consequently, according to the embodiment of the present disclosure, improvement in compressor efficiency of the centrifugal compressor 1 can be achieved, while enhancing static pressure recovery performance of the diffuser 27.

Note that the present invention is not limited to the above-mentioned disclosure of the embodiment, and that it can be carried out in other various aspects, such as applying a technical idea applied to the centrifugal compressor 1 to a gas turbine, an industrial air facility, etc., or arranging a plurality of diffuser vanes (illustration is omitted) spaced apart from each other in a peripheral direction in the diffuser 27. In addition, the scope of right encompassed in the present invention is not limited to these embodiments.

EXAMPLES

Figure 6B:
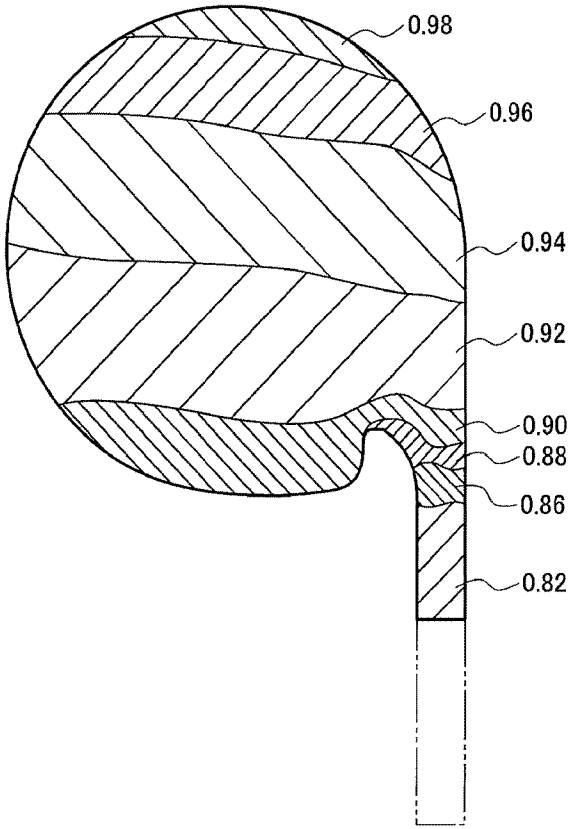
FIGS. 6A and 6B are views each showing static pressure distribution in a scroll and the diffuser in an actuating region near a peak of compressor efficiency.
Figure 6A:
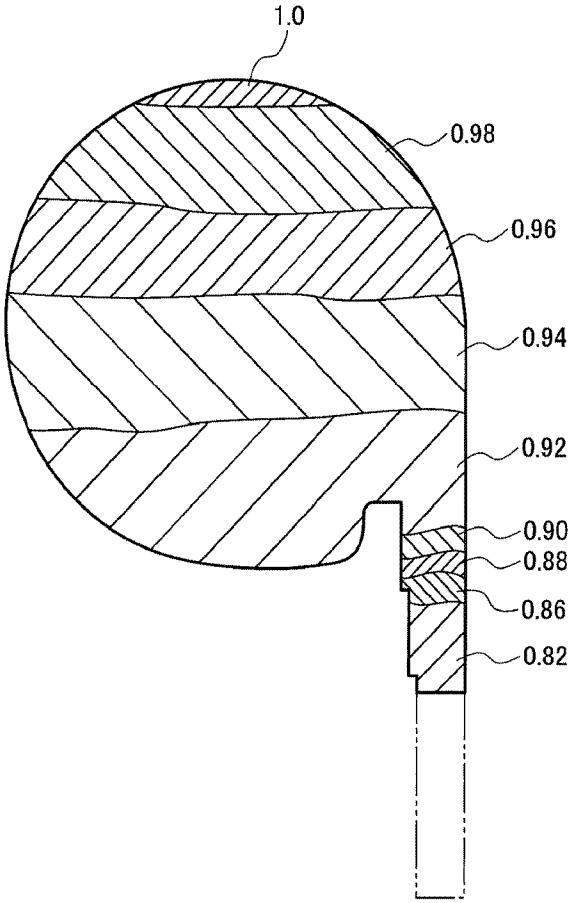
Figure 7:
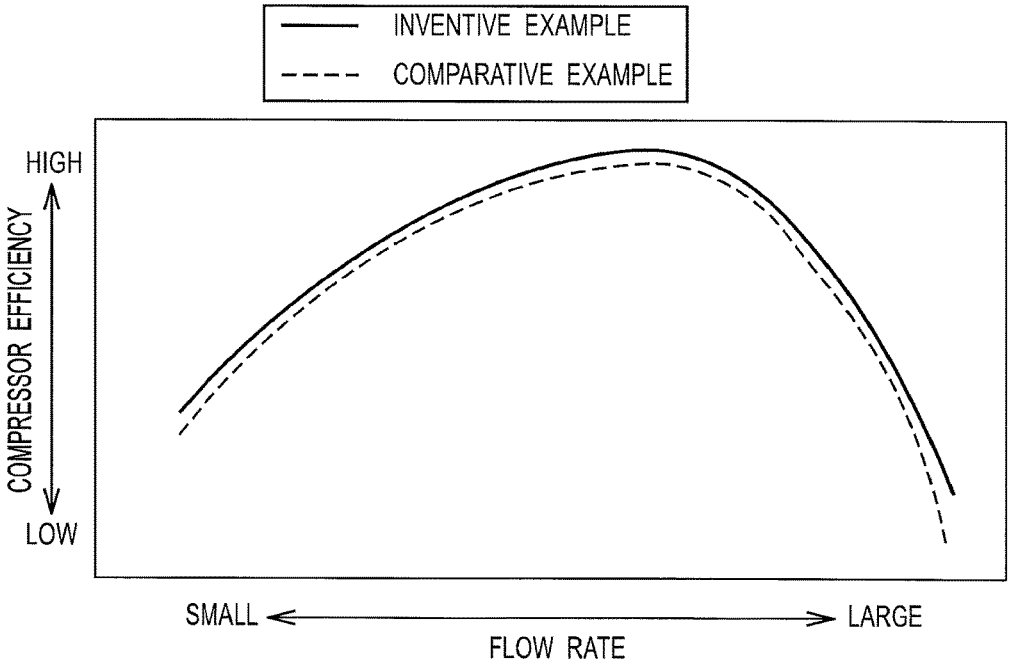
FIG. 7 is a graph showing relations between flow rates and compressor efficiency in the inventive example and the comparative example.

Examples of the present disclosure will be explained with reference to FIGS. 6A, 6B, and 7.

CFD analysis of static pressure distribution in a scroll and a diffuser in an actuating region near a peak of compressor efficiency was performed to the inventive example (refer to FIG. 4A) and the comparative example (refer to FIG. 4B). As a result, it could be confirmed that a static pressure in the scroll could be made to be higher as a whole in the inventive example shown in FIG. 6A, compared with the comparative example shown in FIG. 6B. In other words, it could confirm that static pressure recovery performance of the diffuser could be made to be higher in the inventive example. In addition, although illustration is omitted, similar analysis results could be obtained not only in the actuating region near the peak of the compressor efficiency but also in actuating regions of a small flow rate side and a large flow rate side. Note that numerical values in FIGS. 6A and 6B denote dimensionless static pressures in the scroll.

In addition, there was performed CFD analysis of a relation between a flow rate and compressor efficiency in the inventive example (refer to FIG. 4A) and the comparative example (refer to FIG. 4B). As a result, as shown in FIG. 7, it was confirmed that compressor efficiency was more improved in a wide actuating region from the small flow rate side to the large flow rate side in the inventive example compared with the comparative example.

What is claimed is:

1. A centrifugal compressor configured to compress a fluid utilizing a centrifugal force, comprising:

a housing having a shroud thereinside;

a wheel rotatably provided in the housing;

a diffuser formed outside in a radial direction of an outlet side of the wheel in the housing; and a scroll formed on an outlet side of the diffuser in the housing, wherein a shroud-side wall surface and a hub-side wall surface of the diffuser extend in the radial direction, respectively, wherein a plurality of steps is formed on the shroud-side wall surface of the diffuser so as to expand a flow passage width of the diffuser along a flow direction of a main flow, and wherein a step amount of each step is set to be 5 to 30% of a flow passage width of an outlet of the diffuser.

2. The centrifugal compressor according to claim 1, wherein a radial direction length of a portion continuous with an outside in a radial direction of each step in the shroud-side wall surface of the diffuser is set to be 5 to 30 times of a step amount of each step.

3. The centrifugal compressor according to claim 2, wherein the plurality of steps is formed annularly.

4. The centrifugal compressor according to claim 1, wherein the plurality of steps is formed annularly.

5. A turbocharger comprising the centrifugal compressor according to claim 1.

6. The centrifugal compressor according to claim 1, wherein the plurality of steps is integrally formed with the shroud-side wall surface of the diffuser.

7. A centrifugal compressor configured to compress a fluid utilizing a centrifugal force, comprising:

a housing having a shroud thereinside;

a wheel rotatably provided in the housing;

a diffuser formed outside in a radial direction of an outlet side of the wheel in the housing; and a scroll formed on an outlet side of the diffuser in the housing, wherein a shroud-side wall surface and a hub-side wall surface of the diffuser extend in the radial direction, respectively, wherein a plurality of steps is formed on the shroud-side wall surface of the diffuser so as to expand a flow passage width of the diffuser along a flow direction of a main flow, and wherein a radial direction length of a portion continuous with an outside in a radial direction of each step in the shroud-side wall surface of the diffuser is set to be 5 to 30 times of a step amount of each step.

8. The centrifugal compressor according to claim 7, wherein the plurality of steps is formed annularly.

9. A turbocharger comprising the centrifugal compressor according to claim 7.

10. The centrifugal compressor according to claim 7, wherein the plurality of steps is integrally formed with the shroud-side wall surface of the diffuser.

* * * * *